US008283296B2

(12) United States Patent
Hugues et al.

(10) Patent No.: US 8,283,296 B2
(45) Date of Patent: Oct. 9, 2012

(54) LUBRICANT FOR HOT FORGING APPLICATIONS

(75) Inventors: Laurent Hugues, Soultz les Bains (FR); Harold Gankema, Emmen (NL); Geert Heideman, Qude Pekela (NL); Douwe Marten Kok, Scheemda (NL); Gerko Odink, Winschoten (NL)

(73) Assignee: Henkel AG & Co., KGaA, Duesseldorf (DE)

( * ) Notice: Subject to any disclaimer, the term of this patent is extended or adjusted under 35 U.S.C. 154(b) by 754 days.

(21) Appl. No.: 11/545,883

(22) Filed: Oct. 11, 2006

(65) Prior Publication Data

US 2008/0090740 A1 Apr. 17, 2008

(51) Int. Cl.
*C10M 125/02* (2006.01)
*B21B 45/02* (2006.01)

(52) U.S. Cl. ..... 508/113; 508/122; 508/123; 508/128; 72/42

(58) Field of Classification Search ..... 508/113, 508/313, 316, 346, 348, 349, 421, 427–429, 508/433, 436, 438, 441, 442, 545, 548, 564
See application file for complete search history.

(56) References Cited

U.S. PATENT DOCUMENTS

| | | | | |
|---|---|---|---|---|
| 3,242,075 | A | 3/1966 | Hunter | |
| 3,525,692 | A * | 8/1970 | Cairns et al. | 508/113 |
| 3,933,658 | A | 1/1976 | Beiswanger et al. | |
| 3,966,619 | A | 6/1976 | Smith et al. | |
| 3,977,838 | A | 8/1976 | Hashimoto et al. | |
| 4,206,061 | A | 6/1980 | Dodson et al. | |
| 4,358,509 | A * | 11/1982 | Rysek | 428/461 |
| 4,612,127 | A * | 9/1986 | Uematsu et al. | 72/42 |
| 4,612,128 | A | 9/1986 | Uematsu et al. | |
| 4,740,323 | A * | 4/1988 | Suzuki et al. | 508/337 |
| 5,413,756 | A | 5/1995 | Sahu | |
| 5,437,802 | A | 8/1995 | Kurahashi et al. | |
| 5,830,285 | A | 11/1998 | Katayama et al. | |
| 5,864,745 | A | 1/1999 | Kawagoe et al. | |
| 6,165,950 | A | 12/2000 | Rao et al. | |
| 2002/0042348 | A1 | 4/2002 | McNeil et al. | |
| 2005/0124504 | A1 * | 6/2005 | Zhang et al. | 508/128 |

FOREIGN PATENT DOCUMENTS

| | | |
|---|---|---|
| EP | 0 295074 | 9/1992 |
| GB | 706 443 | 3/1954 |
| GB | 1359430 A | 10/1972 |
| GB | 2257712 | 1/1993 |
| JP | 4189897 A | 7/1992 |
| WO | 8202058 A1 | 6/1982 |
| WO | WO 9943769 | 9/1999 |

OTHER PUBLICATIONS

Supplementary European Search Report dated May 17, 2011 for application EP 07 84 2217. All references cited in the Supplementary European Search Report are listed herein.
International Search Report dated Feb. 19, 2008, International application PCT/US2007/078113 All references cited in the International Search Report are listed herein.
Database WPI, Section Ch, Week 198342, Thomson Scientific, London, GB; AN 1983-793037 XP002635385, "Lubricant for hot working non-ferrous metals", SU 727 672 A (Leningrad Lensovet Tech) Apr. 15, 1980—Abstract only.

* cited by examiner

*Primary Examiner* — Ellen McAvoy
*Assistant Examiner* — Taiwo Oladapo
(74) *Attorney, Agent, or Firm* — Mary K. Cameron

(57) ABSTRACT

A substantially lead-free lubricant for use in hot forging of metals, especially forging of aluminum and aluminum alloy components. The lubricant comprises one or more oils, graphite, and one or more phosphorus-based additives. Additional additives, such as metallic lubricants and dispersants may also be included. The lubricant does not burn when subjected to temperatures in excess of 300° C.

25 Claims, No Drawings

LUBRICANT FOR HOT FORGING APPLICATIONS

FIELD OF THE INVENTION

Forged metal articles are frequently used for various parts in many items, including airplanes, automobiles, electronic components, etc. Iron has traditionally been the metal of choice for most forged metal applications, however the preferred material for many recent applications is changing from iron to lighter alloys, such as aluminum alloys, in order to meet the demand for reducing the overall weight of the material. In recent years, the demand for lightweight products of high quality with good workability has increased and has led to a similar increase in the use of aluminum alloy forging technology.

In the metal forging work or process, a lubricant or lubricating oil is disposed between the metal mold and the workpiece to be molded so as to avoid adhesion between them and to improve the separation ability of the forged article from the metal mold. The proper lubricant is critical in order to allow for proper movement in the die cavities and to allow the forging process to be repeated as many times as possible in succession without re-application of lubricant. Conventional lubricants, which include oil-soluble lubricants with added graphite and water-soluble lubricants consisting of synthetic esters, silicone oils, graphite, extreme-pressure additives and surface active agents, have been typically used as lubricants in aluminum alloy forging.

It is difficult to satisfy the demands of hot aluminum forging by using conventional lubricants. With hot aluminum forging, the existing oil-soluble lubricants have disadvantages, such as flammability, causing smoking and/or workshop contamination, etc. In particular, many oil-soluble lubricants that contain graphite burn when the application temperature is greater than 300° C., such as is required for hot forging of aluminum, causing unsafe working conditions and an increased risk of accidents. Furthermore, the existing water-soluble lubricants have disadvantages including the requirement for treatment of waste water to control water pollution after use which results in cost increases, equipment investment and processing inefficiency.

Many non-flammable additives have been unsuccessfully tested for use in hot forging. For example, halogenated products have been tested, but they produce halogenated residues that are unwelcome for safety and environmental purposes. Magnesium- and borate-based flame retardants have been tested, however they generate residues that negatively affect the lubrication properties. Organic flame retardants in general are not effective because they are not designed to work at temperatures above 300° C. Further, antimony and barium based products are generally not effective in hot forging applications.

Conventional hot aluminum forging lubricants that best facilitate die movement typically include one or more organic lead compounds, such as lead naphthenate and lead stearate. The use of lead in lubricating compositions has come into disfavor because of the health hazards caused by the release of lead into the atmosphere. During the hot forging of aluminum some of the organic lead present in the lubricant is dispersed into the air in quantities which are unacceptable to most local and national governmental regulatory agencies. Such agencies have banned the use of lead in many industries and, where it is still allowed, severely limited the concentrations that may be discharged into the atmosphere. In order to continue using lead-containing lubricants, the hot forging industry would be required to install very expensive exhaust and air filtration systems to lower the concentration of atmospheric lead to acceptable limits. Such exhaust and filtration systems would not be economically feasible for many aluminum hot forging facilities.

It would therefore be advantageous to provide a substantially lead-free lubricant for use in the aluminum and aluminum alloy hot forging industry. Such lubricants provide superior lubrication properties and should not produce smoke or be flammable at temperatures at or above 300° C.

SUMMARY OF THE INVENTION

The present invention discloses a lubricant for use in hot forging or metal deformation of metals, especially aluminum and aluminum alloy components, titanium and superalloys. The lubricant comprises one or more oils, graphite, and one or more phosphorus-based additives. Additional additives, such as metallic lubricants, dispersants, thickeners and wetting agents may also be included. The lubricant of the present invention is substantially lead-free and does not burn when subjected to temperatures in excess of 300° C.

DETAILED DESCRIPTION OF THE INVENTION

The present invention discloses a lubricant for use in hot-forging applications, such as those utilized in forging aluminum and aluminum workpieces into the desired articles. Such hot forging applications require lubricant materials that do not produce smoke or flame in the general temperature range of about 300° C. to about 600° C. In order to comply with safety and health regulations, such lubricants are substantially lead-free.

The lubricant of the present invention is an oil-based lubricant. The oil utilized may be virtually any composition known in the art, including but not limited to mineral oil, such as naphtenic, aliphatic, paraffinic or steam cylinder oil, vegetable oil, such as sunflower oil, olive oil or rapeseed oil, animal oil, such as lard oil, synthetic oil, such as polyalphaolefins and silicone oil, semi-synthetic oil, such as glycerol trioleate and mixtures thereof. Preferred oils include vegetable, mineral and animal oils. Such oils are commercially available as Process Oil 1000 from Texaco (UK), Lard oil from Welch, Holm and Clark Co. (USA), Soybean oil from BG International (USA.).

A second component of the lubricant is a graphite additive. The graphite may be in any form known in the art, including but not limited to coarse, fine, milled, unmilled, natural, synthetic or mixtures thereof. The graphite component of the lubricant provides for a physical separation between the workpiece and the die during the forging operation. Fine graphite having a particle size distribution with about 90% of the particles below 15 microns in size is especially preferred. Such graphite is commercially available from Acheson Industries, Inc.

One or more phosphorus-based additives are included in the lubricant. The phosphorus additive reduces and eliminates burning of the lubricant at high temperatures. The phosphorus can be in any desired form, such as phosphate, ester phosphate, phosphate amine, ammonium phosphate or mixtures thereof. One preferred phosphorous-based material is phosphate ester. Such phosphorous is commercially available from Connect Chemical (F), Ferro (USA).

The hot forging lubricant composition optionally contains one or more metallic lubricating additives. The metallic additives may be chosen from one or more of the metallic elements, including tin, bismuth, zinc, aluminum or any alloys thereof.

The lubricant composition may optionally contain additional ingredients such as dispersants, rheology modifiers, biocides, anticorrosives, extreme pressure additives, antifoam agents, wetting agents, metal soaps and mixtures thereof.

The lubricant of the present invention comprises in the range of about 1 to about 99 weight percent oil, preferably in the range of about 1 to about 70% oil and most preferably in the range of about 15 to about 40 weight percent oil. The lubricant contains in the range of about 1 to about 99 weight percent graphite, preferably in the range of about 1 to about 30 weight percent graphite and most preferably in the range of about 3 to about 20 weight percent graphite. The lubricant contains in the range of about 1 to about 99 weight percent phosphorous additive, preferably in the range of about 1 to about 80 weight percent phosphorous additive and most preferably in the range of about 30 to about 80 weight percent of the phosphorous additive.

A further embodiment of the invention comprises a method for forging an article. The method comprises the steps of applying the lead-free lubricant to one or both of the forging apparatus or the workpiece to be forged. The workpiece is inserted into the forging apparatus and forged into the desired article. The forging apparatus is opened and the article is easily removed due to the presence of the lubricant. In an alternative embodiment, the workpiece is inserted before the application of the lubricant and the workpiece and die surface are then lubricated simultaneously The invention is further illustrated by the following non-limiting example:

Example. A lubricant composition may be produced by adequately mixing the raw materials together via standard mixing techniques, such as mastication of stirring. The composition of the samples is shown in Table 1.

TABLE 1

Lubricant Sample Composition

| Ingredient | Weight Percent |
|---|---|
| Vegetable/Animal Oil | 15% |
| Fine Graphite | 4.4% |
| Mineral Oil | 3.2% |
| Metal containing Fatty Acid Derivative | 3.2% |
| Phosphate Ester | 73% |
| Dispersant | 0.2% |

The lubricant composition of Table 1 was applied on hot forging dies at temperatures of 440° C.±40° C. The dies were utilized for a series of hot aluminum forging applications and the lubricant did not produce flames during the process. In addition, the lubricant properties relating to the die and the aluminum part being forged were superior.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

We claim:

1. A method of hot forging an aluminum or aluminum alloy comprising the steps of a) applying a coating of a lead-free lubricant to one or both of a hot forging apparatus or a workpiece, inserting the workpiece into the apparatus and forging an article from the workpiece or b) inserting a workpiece into a hot forging apparatus, simultaneously lubricating the workpiece and the hot forging apparatus, and forging the workpiece, wherein the lead-free lubricant comprises about 15 to about 40 weight percent of one or more oils including at least one mineral oil, fine graphite having a particle size distribution with about 90% of the particles below 15 microns in size, and 30 to 80 weight percent of one or more phosphate esters.

2. The method of claim 1, the lubricant further comprising one or more metallic lubricating additives.

3. The method of claim 2, wherein the one or more metallic additives are selected from the group consisting of bismuth, zinc, tin, aluminum or any alloys thereof.

4. The method of claim 1, wherein the graphite comprises in the range of about 1 to about 30 weight percent of the lubricant.

5. The method of claim 1, wherein the graphite comprises in the range of about 3 to about 20 weight percent of the lubricant.

6. The method of claim 1, the lubricant further comprising one or more of the group consisting of dispersants, rheology modifiers, biocides, anticorrosives, extreme pressure additives, antifoam agents, wetting agents, metal soaps or mixtures thereof.

7. The method of claim 1, wherein the phosphate esters are selected such that the lubricant does not burn at temperatures greater than about 300° C.

8. The method of claim 1, wherein the phosphate esters are selected such that the lubricant does not burn at temperatures in the range of about 300° C. to about 600° C.

9. The method of claim 1, further comprising the step of coating the workpiece with the lubricant.

10. The method of claim 1 wherein the method is carried out at an application temperature of about 300° C. to about 600° C.

11. The method of claim 1 wherein the method is carried out at an application temperature of 400° C. to 480° C.

12. The method of claim 1 wherein the hot forging apparatus is at a temperature of 400° C. to 480° C. when the coating of the lead-free lubricant is applied.

13. The method of claim 1, the lubricant further comprising one or more metal-containing fatty acid derivatives.

14. The method of claim 1, wherein the coating of lead-free lubricant is applied to the hot forging apparatus before inserting the workpiece into the apparatus and forging the article from the workpiece.

15. The method of claim 1, wherein the coating of lead-free lubricant is applied to the workpiece before inserting the workpiece into the apparatus and forging an article from the workpiece.

16. The method of claim 1, wherein the coating of lead-free lubricant is applied to both the hot forging apparatus and the workpiece before inserting the workpiece into the apparatus and forging an article from the workpiece.

17. The method of claim 1, wherein the workpiece is inserted into the hot forging apparatus before simultaneously lubricating the workpiece and the hot forging apparatus, and forging the workpiece.

18. A method of hot forging an aluminum or aluminum alloy comprising the steps of a) applying a coating of a lead-free lubricant to one or both of a hot forging apparatus and a workpiece, inserting the workpiece into the apparatus and forging an article from the workpiece or b) inserting a workpiece into a hot forging apparatus, simultaneously lubricating the workpiece and the hot forging apparatus, and forging the workpiece, wherein the lead-free lubricant consists of:

15-40 weight % of one or more oils, including at least one mineral oil;

3-20 weight % fine graphite having a particle size distribution with about 90% of the particles below 15 microns in size;

30-80 weight % of one or more phosphate esters;

one or more metal-containing fatty acid derivatives; and one or more dispersants.

19. The method of claim 18 wherein the method is carried out at an application temperature of about 300° C. to about 600° C.

20. The method of claim 18 wherein the method is carried out at an application temperature of 400° C. to 480° C.

21. The method of claim 18 wherein the hot forging apparatus is at a temperature of 400° C. to 480° C. when the coating of the lead-free lubricant is applied.

22. The method of claim 18, wherein the coating of lead-free lubricant is applied to the hot forging apparatus before inserting the workpiece into the apparatus and forging the article from the workpiece.

23. The method of claim 18, wherein the coating of lead-free lubricant is applied to the workpiece before inserting the workpiece into the apparatus and forging an article from the workpiece.

24. The method of claim 18, wherein the coating of lead-free lubricant is applied to both the hot forging apparatus and the workpiece before inserting the workpiece into the apparatus and forging an article from the workpiece.

25. The method of claim 18, wherein the workpiece is inserted into the hot forging apparatus before simultaneously lubricating the workpiece and the hot forging apparatus, and forging the workpiece.

* * * * *